US005277789A

United States Patent [19]

Kounaves et al.

[11] Patent Number: 5,277,789

[45] Date of Patent: Jan. 11, 1994

[54] METAL, METAL ALLOY, AND METAL OXIDE FORMATION BY ELECTRODEPOSITION OF POLYMETALLIC COMPLEXES

[75] Inventors: Samuel P. Kounaves, Winchester; Albert Robbat, Jr., Andover; Geoffrey Davies, Lexington, all of Mass.

[73] Assignees: Tufts University, Medford; Northeastern University, Boston, both of Mass.

[21] Appl. No.: 905,566

[22] Filed: Jun. 29, 1992

[51] Int. Cl.[5] ..... C25D 3/56

[52] U.S. Cl. ..... 205/238; 205/239; 205/240; 205/261; 205/296; 205/291

[58] Field of Search ..... 205/238, 239, 261, 296, 205/291, 240

[56] References Cited

U.S. PATENT DOCUMENTS 4,933,003 6/1990 Marzik et al. ..... 75/362

5,061,313 10/1991 Davies et al. ..... 75/362

OTHER PUBLICATIONS

El-Sayed et al., Inorg. Chem. vol. 29, pp. 4891–4897 (1990).

Cotton and Wilkinson, Advanced Inorganic Chemistry, Fifth Edition, p. 38 (Wiley-Interscience, New York 1988).

El-Sayed et al., Inorganica Chimica Acta, vol. 182, pp. 213–220 (1991).

*Primary Examiner*—John Niebling

*Assistant Examiner*—Patrick J. Igoe

*Attorney, Agent, or Firm*—Kriegsman & Kriegsman

[57] ABSTRACT

A novel method for making metals and homogeneous metal alloys comprises the steps of (a) providing a polymetallic complex of the general formula $$(\mu_4\text{-}0)L_4M'M''M'''M''''X_n$$

wherein L is a ligand selected from the group consisting of organic and inorganic ligands, wherein M', M'', M''', and M'''' are metal atoms two or more of which may be the same, wherein X is a halogen atom, and wherein n is an integer ranging from 4 to 6; and (b) electrochemically depositing at least one of the metals from said polymetallic complex.

19 Claims, 3 Drawing Sheets

METAL, METAL ALLOY, AND METAL OXIDE FORMATION BY ELECTRODEPOSITION OF POLYMETALLLIC COMPLEXES

BACKGROUND OF THE INVENTION

The present invention relates generally to methods for manufacturing metals, metal alloys, and metal oxides and more particularly to a method for manufacturing metals, metal alloys, and metal oxides by electrodeposition of polymetallic complexes.

The utility of metals, metal alloys, and metal oxides in, for example, the semiconductor industry, the magnetic recording materials industry, and the chemical catalyst industry, is well established. For instance, compositionally uniform mixed metals and alloys are extensively used as nanostructural materials, thin films, and catalysts. Certain nickel-containing alloys are used for oxidative protection of very fine ferromagnetic iron particles in various types of magnetic recording media. Fine metal and metal oxide powders are strategically important materials and are the bedrock of industry. Morphologically uniform mixed-metal and alloy powders are also of intense interest for their utility in selective catalysis. Accordingly, better ways for making metals, metal alloys, and metal oxides are constantly being sought.

Many different techniques presently exist for producing metals, metal alloys, and metal oxides. Examples of conventional techniques include the thermal decomposition of solid or gaseous metallic compounds and the reduction of metal ions in solution. Unfortunately, only in rare cases can these methods be used to obtain highly dispersed mixed-metal deposits. In fact, the electrodeposition of many desirable alloys from solutions containing separate sources of different metals (e.g. Cu from $CuCl_2$ and Ni from $NiCl_2$) is particularly difficult since each metal is typically reduced at a different potential and at a different rate for a fixed potential. Additionally, as a general rule, these conventional methods of synthesis typically offer very little control over the composition, morphology, or catalytic properties of the synthesized products. Moreover, these methods rarely result in the formation of single grains of metallic powders that are smaller than about 1 micron in diameter as aggregates of many contiguous crystallites readily form.

In U.S. Pat. No. 4,933,003, which issued to Marzik et al. on Jun. 12, 1990, and which is incorporated herein by reference, there is disclosed a method for forming a single-phase, homogeneous and high surface area metal alloy. The method described therein comprises the following two-step process: (1) formation by a transmetalation reaction of a heteropolymetallic complex containing the desired metals (See, e.g., El-Toukhy et al., J. Amer. Chem. Soc., Vol. 106, 4596 (1984); Davies et al., Inorg. Chem., Vol. 25, 2373 (1986); Davies et al., Comm. Inorg. Chem., Vol. 8, 203 (1989); Abu-Raqabah et al., Inorg. Chem., Vol. 28, 1156 (1989); Al-Shehri et al., Inorg. Chem., Vol. 29, 1198 (1990); and Caulton et al., Polyhedron, Vol. 9, 2319 (1990), all of which are incorporated herein by reference, for information on the formation of polymetallic complexes by transmetalation reactions.); and (2) reduction of the heteropolymetallic complex to a single-phase alloy by heating the complex in hydrogen gas to a temperature equal to or greater than its decomposition temperature for a sufficient period of time.

In U.S. Pat. No. 5,061,313, which issued to Davies et al. on Oct. 29, 1991, and which is incorporated herein by reference, there is disclosed another method for forming a single-phase, homogeneous and high surface area metal alloy. The method described therein comprises the following two-step process: (1) formation by a transmetalation reaction of a heteropolymetallic complex containing the desired metals; and (2) reduction of the heteropolymetallic complex a single-phase alloy by heating the heteropolymetallic complex for a sufficient period of time in an inert atmosphere to a temperature at which reductive decomposition occurs.

Additional studies have disclosed that thermoloysis of the heteropolymetallic complex $(\mu_4\text{-O})N_4CoNiCuZnCl_6$ in $O_2$ at approximately 220 degrees Celsius gives highly dispersed mixtures of $Co_3O_4$, NiO, CuO and ZnO. The formation of separate oxides rather than complex oxide phases is thought to be the result of the intervention of a molten precursor state.

In *Inorganica Chimica Acta*, Vol. 182, pp. 213–220 (1991), El-Sayed et al. disclose the results of routine cyclic voltammetric studies performed at a Pt electrode in 0.1M tetrabutyl ammonium perchlorate-methylene chloride (TBAP-MC) with polymetallic complexes of the formula $(\mu\text{-O})\ (N,py)_4Cu_{4-x}Ni_xCl_6$, wherein N is N,N-diethylnicotinamide and py is pyridine. These redox behavior studies suggested that polymetallic complexes of the formula $(\mu\text{-O})\ (N,py)_4Cu_{4-x}Ni_xCl_6$ are electrochemically inactive, i.e., they do not produce an electrochemical response, a deposition of metal, or result in the reduction/oxidation of the polymetallic complex. El-Sayed et al. also disclose analogous studies performed under the same conditions with polymetallic complexes of the formula $(\mu\text{-Y})N_4Cu_{4-x}(OH)_2Ni_xCl_4.3H_2O$ (where Y=3,4,5,6-tetrachlorocatecholate). Although these studies showed some electrochemical activity, i.e., quasi-reversible behavior, with the peak potentials altered by substitution of nickel for copper, the electroactivity found with this latter group of complexes was attributed to the ligands, i.e., the catecholate groups. In no instance was electrodeposition reported or demonstrated by their data.

SUMMARY OF THE INVENTION

It is an object of the present invention to provide a novel method for manufacturing metals, metal alloys, and metal oxides.

It is another object of the present invention to provide a method as described above which is capable of producing compositionally and morphologically uniform metal alloys of high surface area.

It is still another object of the present invention to provide a method as described above which is capable of producing small metal particles, i.e., less than about 1 micron.

It is still yet another object of the present invention to provide a method as described above which can be performed under conditions that are more mild and more easily controllable than the conditions under which thermolytic reduction of heteropolymetallic complexes are currently performed.

It is a further object of the present invention to provide a method as described above which can be controlled to alter the composition and/or the morphology of the resulting product.

To achieve the purpose of the invention as broadly set forth above, a method for manufacturing a metal or metal alloy according to the teachings of the present invention is provided which comprises the steps of (a) providing a polymetallic complex of the formula:

$$(\mu_4\text{-O})L_4M'M''M'''M''''X_n$$

wherein L is a ligand selected from the group consisting of organic and inorganic ligands, wherein M', M'', M''', and M'''' are metal atoms two or more of which may be the same, wherein X is a halogen atom, and wherein n is an integer ranging from 4 to 6; and (b) then, applying an appropriate electric potential to said polymetallic complex to cause the electrochemical deposition of at least one of M', M'', M''', and M''''.

As can readily be appreciated, one variation to the above-described method involves oxidizing the polymetallic complex, either electrochemically or otherwise, to form some intermediate complex(es) and then electrochemically reducing said intermediate complex(es) to form the desired deposit. Other variations of the nature should be readily apparent to those of ordinary skill in the art and are considered to fall within the scope fo the present invention.

As can also be readily appreciated, one should be able to obtain oxidized metals by stopping reduction before completion. Accordingly, the production of metal oxides according to the general technique described above is considered to fall within the scope of the present invention.

One particularly desirable aspect of the present method is that the electrochemical deposition step can typically be performed at room temperature. This is clearly advantageous since existing techniques involving the thermolytic reduction of transmetalation polymetallic complexes typically require the heating of such complexes to elevated temperatures in excess of several hundred degrees Celsius.

Another particularly desirable aspect of the present method is that the electrochemical deposition step can typically be completed in a matter of seconds. This is considerably less time than the several hours that is typically required for the thermolytic reduction of transmetalation polymetallic complexes.

Still another desirable aspect of the present method is that the morphology of the resulting deposit can be made to be either a film or a particle depending on whether a cycled potential or a constant potential, respectively, is used to reduce the complex. Therefore, any potential waveform, e.g., linear, step-function, alternating, or the like, is applicable and evident.

Still yet another desirable aspect of the present method is that the composition of the resulting deposit can be altered by varying the cathodicity of the applied potential and/or by varying the types of solvents, electrolytes, electrode materials, and the like that are used.

Additional objects, features, and advantages of the present invention will be set forth in part in the description which follows, and in part will be obvious from the description or may be learned by practice of the invention. In the description, reference is made to the accompanying drawings which form a part thereof and in which is shown by way of illustration specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In these drawings.

DETAILED DESCRIPTION OF PREFERRED EMBODIMENTS

Figure 1:
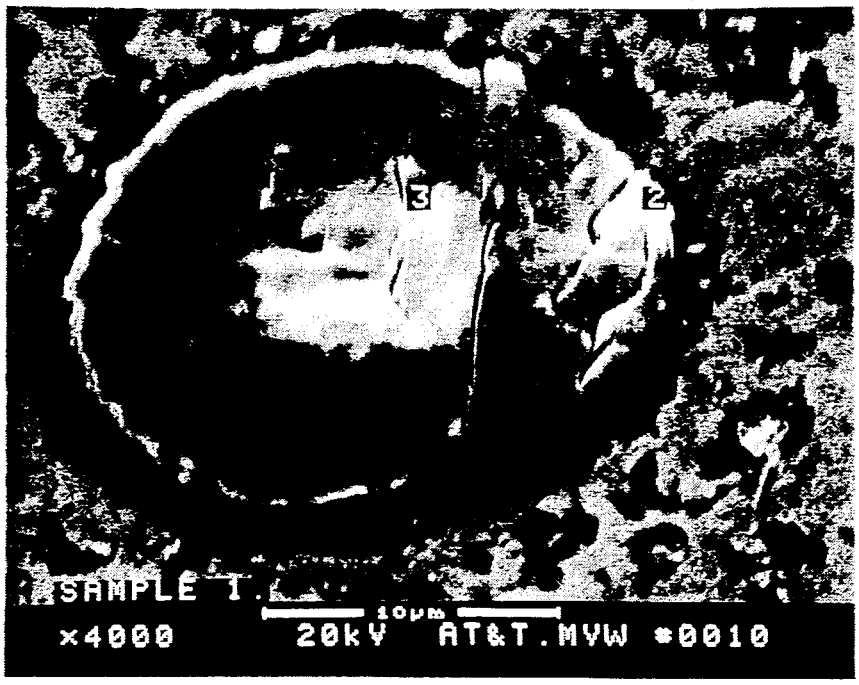
FIG. 1 is a representative SEM micrograph of the surface of the electrochemical deposit formed in Example 1.

As discussed above, the present invention relates to a novel method for producing metals, metal alloys, metal oxides, and the like. The present method makes use of surprising discovery that polymetallic complexes of the general formula $$(\mu_4\text{-O})L_4M'M''M'''M''''X_n \qquad (I)$$

wherein L is either an organic ligand or an inorganic ligand, wherein M', M'', M''', and M'''' are either the same or different metals, wherein X is a halogen, and wherein n is an integer ranging from 4 to 6, are electroactive and can be electrochemically deposited. The present invention also makes use of the discovery that the morphology and composition of deposits made according to the above-described method can be modified and controlled by the appropriate selection of electrochemical deposition conditions.

The first step to producing a desired metal or metal alloy deposit in accordance with the teachings of the present invention involves obtaining a polymetallic complex of general formula I, the polymetallic complex having incorporated thereinto those metal atoms with which one wishes to make the desired metal or metal alloy. It has been found that a particularly advantageous method for obtaining desired polymetallic complexes of general formula I is by transmetalation.

As noted above, virtually any combination of four transition metal atoms, two or more of which may be the same type of metal atom, may be incorporated into the polymetallic complex of general formula I (one notable exception being combinations having more than two zinc atoms— other exceptions being readily identifiable to those of ordinary skill in the art based on steric and/or electronic considerations). In a specific embodiment of the invention, the four transition metal atoms are $Cu_{4-w-y-y}$, $Co_w$, $Ni_z$, and $Zn_z$, with w and y being integers ranging from 0 to 4, z being an integer ranging from 0 to 2, and $0<w+y+z<4$. This gives a family of 32 related homo- and heteropolymetallic complexes for every fixed combination of L and X. In another specific embodiment of the invention, the four metal atoms are $Cu_{4-w}$ and $Ni_w$, with w being an integer ranging from 0 to 4. This gives a family of 5 related homo- and heteropolymetallic complexes for every fixed combination of L and X.

Examples of suitable ligands L for the polymetallic complex of general formula I include pyridine (py) and N,N-diethylnicotinamide (N). The halogen atom X of polymetallic complex of general formula I is preferably chlorine, bromine, or iodine, more preferably chlorine or bromine. The value of n of polymetallic complex of general formula I is preferably 6.

The second step to producing a desired metal or metal alloy deposit in accordance with the teachings of the present invention comprises electrochemically reducing the polymetallic complex of general formula I, either with or without preceding oxidation, with a sufficient electrical potential to cause one or more of the metal atoms incorporated into the complex to be deposited on a substrate.

As a general matter, to achieve any degree of electrochemical deposition of the polymetallic complex, one must select an appropriate solvent, an appropriate supporting electrolyte, an appropriate working electrode, and an appropriate electric potential.

Preferred solvents for purposes of the present invention are those solvents which are non-reactive with the polymetallic complex, or which react in a manner facilitating electrodeposition, and in which the polymetallic complex is soluble. Examples of suitable solvents include methylene chloride and acetonitrile. Suitable supporting electrolytes for purposes of the present invention are those electrolytes which are non-reactive with the polymetallic complex and which provide good electrical conduction. Examples of suitable electrolytes include tetraalkyl ammonium perchlorates and tetraalkyl ammonium fluoroborates. Suitable working electrodes for purposes of the present invention are those electrodes which are substantially inert. Examples of suitable working electrodes include glassy carbon and platinum.

The specific electric potential necessary to cause some deposition of at least one of the metals in the polymetallic complex will typically vary according to the composition of the complex. Nevertheless, as a general principle, some form of deposition typically occurs as the electric potential approaches one or more of the redox potentials for the complex. Accordingly, one will typically start at an oxidizing potential and then shift to a potential at which the complex is reduced.

The morphology of the deposited product has been found to be affected by the type of electric potential waveform applied. Where, for example, the electric potential is constant, the deposited product typically takes the form of a plurality of small particles (which may be as small as approximately 1 micron). In contrast, where the electric potential is cycled, the deposited product typically takes the form of a thin film. It is believed that the morphology of the deposited product also may be affected by the selection of solvents, electrolytes, working electrodes, and the like.

Where the complex is heteropolymetallic (as opposed to homopolymetallic), the composition of the deposited product, i.e., the respective ratios of the constituent metals, has been found to be affected by altering the cathodicity of the applied electric potential. In other words, where the complex has a multiplicity of redox peak potentials, the composition of the deposited product has been found to vary as the applied potential is varied between the various redox peaks. The specific locations of the redox peaks for a given complex may be affected by the selection of specific parameters, such as solvents, electrolytes, reference electrodes and working electrodes.

As noted above, the electrochemical deposition of the present invention can be performed at a wide range of temperatures, including at room temperature. This is a considerable advantage over thermolytic reductions, which often take place at elevated temperatures that can promote particle sintering. Another advantage of the electrochemical deposition of the present invention is that it can be completed in a matter of seconds. This is considerably less time than is typically required for thermolytic reductions.

It is envisioned that successive iterations of the method of the present invention may be used to make multi-layered metallic products.

The following examples illustrate specific embodiments of the present invention. The examples should in no way be considered limiting, but rather, are merely illustrative of the various features of the present invention.

EXAMPLE 1

A polymetallic complex of the formula $(\mu_4\text{-O})N_4Cu_2Ni_2Cl_6$, wherein N is N,N-diethylnicotinamide, was dissolved in methylene chloride (MC) at a concentration of $10^{-3}$M. 0.1M tetrabutyl ammonium perchlorate (TBAP) was added to the solution as a supporting electrolyte. Glassy carbon (GC) was inserted into the solution as the working electrode, and a Ag/0.01M $AgNO_3/CH_3CN$ halfcell with a MC bridge was used as the reference electrode. An electric potential cycled five times between 1800 mV and −950 mV at a rate of 500 mV/s was then applied across the electrodes. (All potentials reported here are in reference to the above-noted reference electrode.) The process was conducted at room temperature (approximately 22–25 degrees Celsius).

As a result of the above-described process, a metallic deposite was formed on the GC electrode. Micrographs of the electrodeposited surface were obtained using AMRAY-1610 and JEOL JXA-840 scanning electron microscopes (SEM). FIG. 1 is one such SEM micrograph of the electrodeposited surface (taken at 20 KV, X4000, 10 μm bar). As can be seen, the SEM micrograph shows a homogeneous distribution of small 10–15 μm diameter "islands" of deposited material in the form of a dried, cracked film. The identity of the deposited elements was determined using an AMRAY-1610 SEM with a PGT energy dispersive X-ray detector. This analysis indicated that the composition by weight at area-2 (as seen in FIG. 1) is 75% Cu, 15% Ni, and 10% Cl and that the composition by weight at area-3 (as seen in FIG. 1) is 89% Cu, 8% Ni, and 3% Cl.

EXAMPLE 2

A second electrochemical deposit of $(\mu_4\text{-O})N_4Cu_2Ni_2Cl_6$ was performed using a process similar to that described in Example 1, the only difference between the two processes being that, in the present process, an electric potential of +1800 mV was initially applied for 5 seconds and was then stepped to a constant potential of +100 mV (this latter potential corresponding approximately to the cathodic side of the first distinct reduction step observed in the cyclic voltammogram of the complex shown in FIG. 3(*a*).

Figure 2:
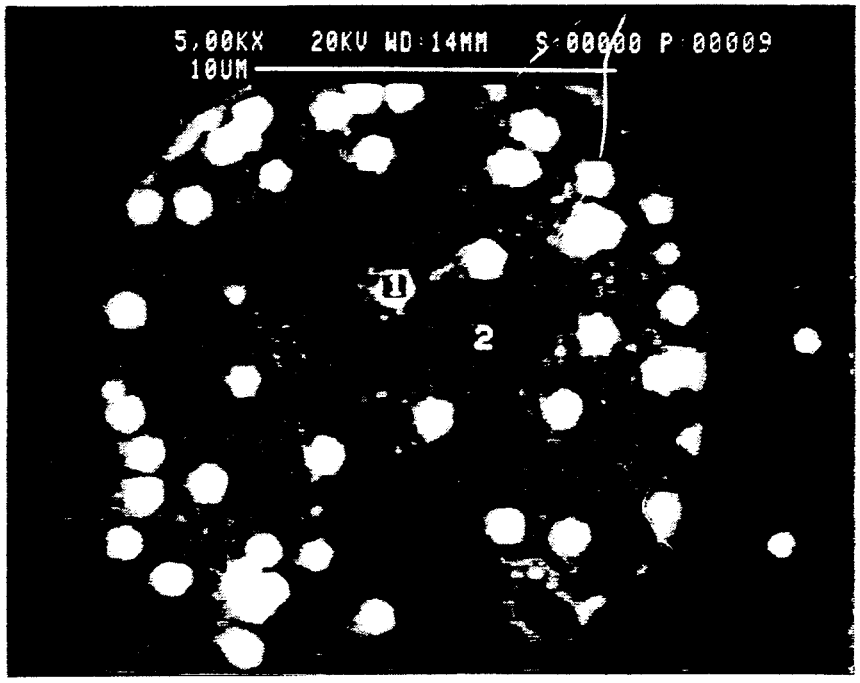
FIG. 2 is a representative SEM micrograph of the surface of the electrochemical deposit formed in Example 2.
Figure 3A:
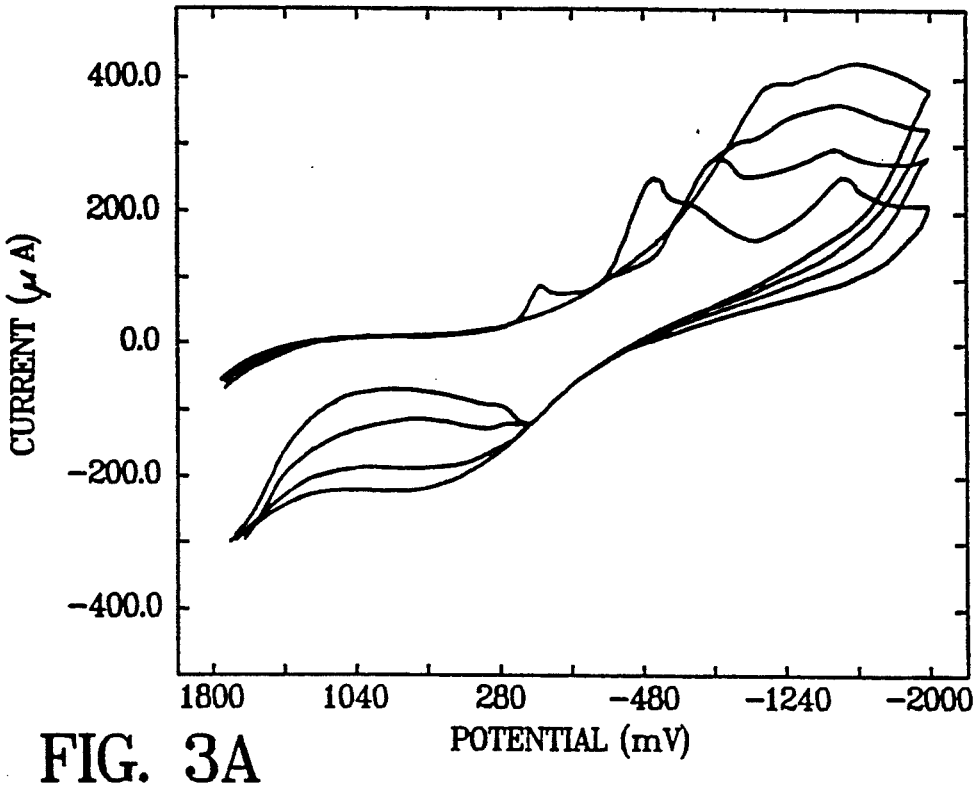
FIG. 3(*a*) through 3(*d*) are various cyclic voltammograms obtained in the fashion described in Example 3.
Figure 3B:
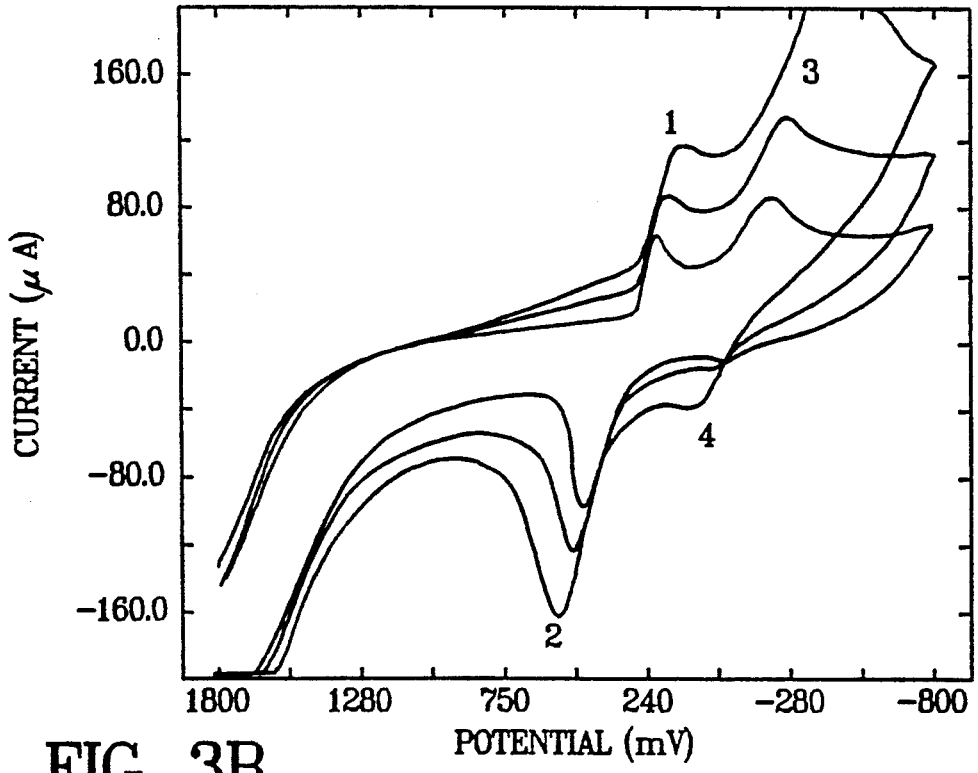
Figure 3C:
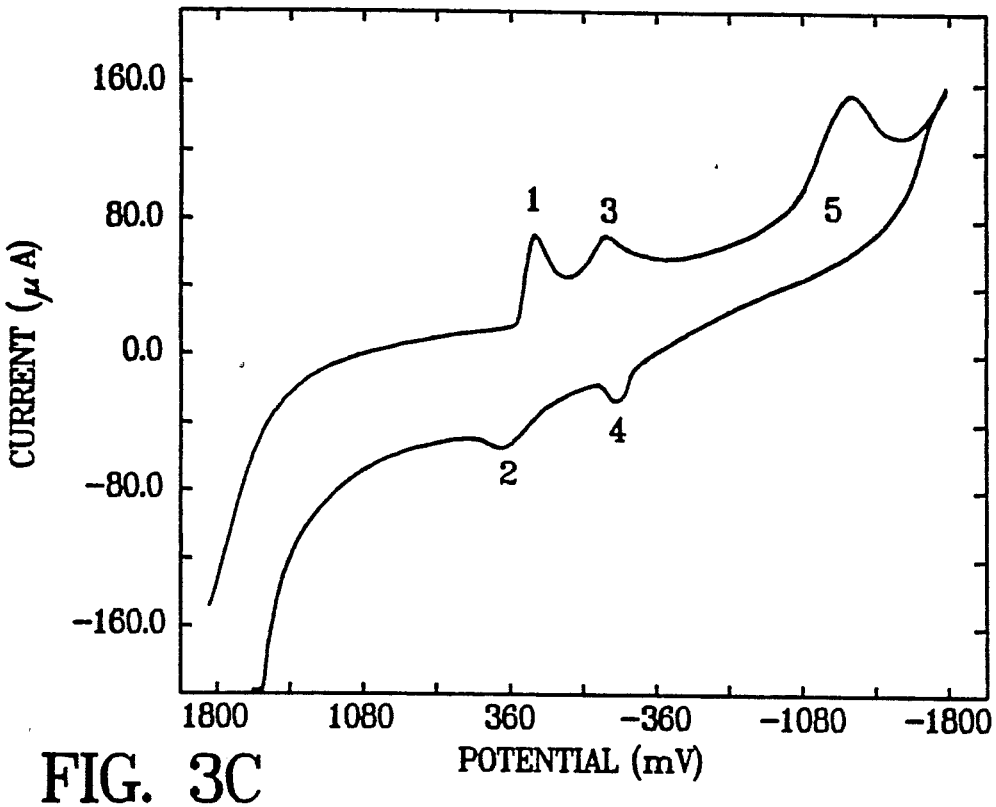
Figure 3D:
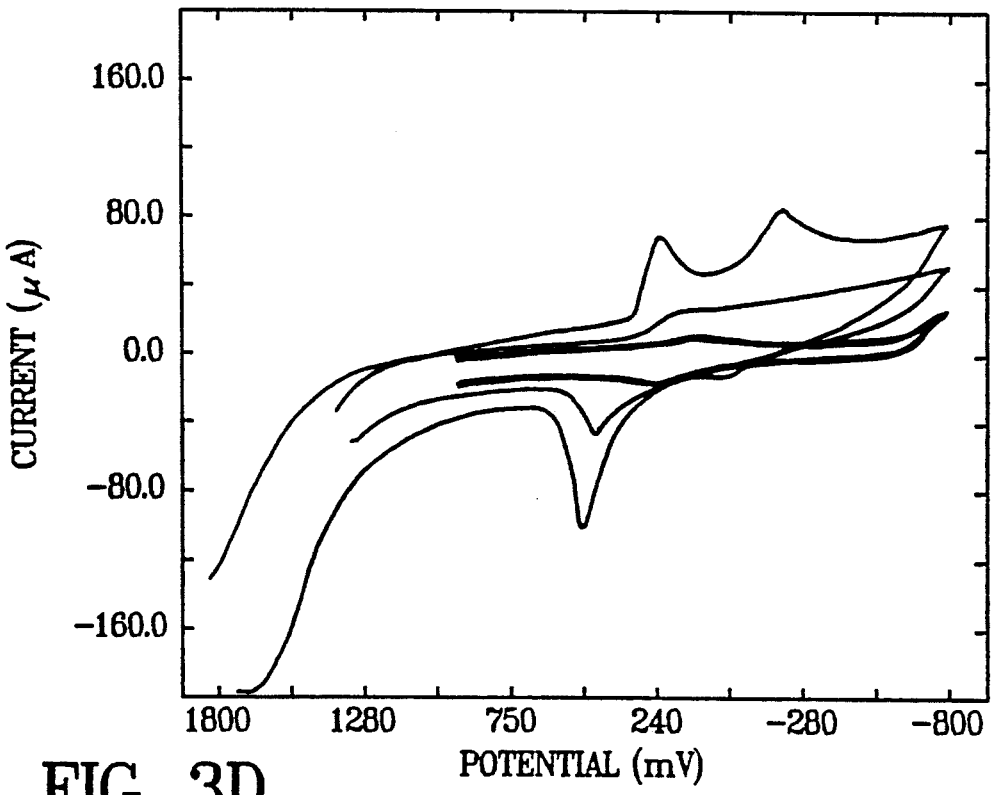

Micrographs of the surface of this second electrochemical deposit were also obtained using AMRAY- 1610 and JEOL JXA-840 scanning electron microscopes (SEM). FIG. 2 is one such SEM micrograph of the surface of this second deposit (taken at 20 KV, X5000, 10 μm bar). As can be seen, the SEM micrograph of this deposit also shows small islands of material; however, the surface layer is composed of approximately 0.1 μm aggregated particles, on top of which are scattered 1-30 small pentagon-shaped particles of about 1-2 μm in diameter. The identity of these deposited elements was also determined using an AMRAY-1610 SEM with a PGT energy dispersive X-ray detector. This analysis indicated that the composition by weight at area-1 (as seen in FIG. 2) is 85% Cu, 1% Ni, and 14% Cl and that the composition by weight at area-2 (as seen in FIG. 2) is 87% Cu, 9% Ni, and 4% Cl.

It appears from this that the ratio of Cu:Ni can be controlled by the cathodicity of the applied potential. At potential values just on the cathodic side of the first peak in the cyclic voltammogram of the compound, a mostly Cu deposit is obtained. To approach a 1:1 ratio of copper to nickel, the deposition potential must be held substantially more cathodic than the second cyclic voltammogram peak, i.e., at values more negative than −1000 mV.

EXAMPLE 3

Cyclic voltammogram studies were performed with representative members of the polymetallic family $(\mu_4\text{-O})L_4Cu_{4-x}Ni_xCl_6$. The four complexes studied were $(\mu_4\text{-O})py_4Cu_4Cl_6$, $(\mu_4\text{-O})N_4Cu_4Cl_6$, $(\mu_4\text{-O})N_4Cu_3NiCl_6$, and $(\mu_4\text{-O})N_4Cu_2Ni_2Cl_6$. The first two complexes were selected to identify redox differences due to the substitution of the ligand L. The second, third, and fourth complexes were selected to observe the effects of changing the Cu to Ni ratio. Two different solvents (methyl chloride (MC) and acetonitrile (AN)), two different electrolytes (tetrabutyl ammonium perchlorate (TBAP) and tetrabutyl ammonium tetrafluoroborate (TBAF)), and three different electrode substrates (mercury, platinum, and glassy carbon) were used. The respective responses of these compounds over a potential range of +1.8 to −2.0 volts and scan rates of 50 to 1500 mV/sec were observed.

The electroactivity of these compounds was immediately evident as cyclic voltammogram peaks were obtained for all complexes with all three types of electrodes in all solvent/electrolyte systems at several redox potentials. In all cases, an electrodeposited film was obtained on the working electrode surface. This film, which became evident after the first scan, altered the multiple CV scan response, significantly shifting the peaks to more cathodic potentials. This can clearly be seen in FIG. 3(*a*) for $(\mu_4\text{-O})N_4Cu_2Ni_2Cl_6$ in MC/0.1M TBAP at GC and multiple 500 mV/s scans versus the same reference electrode.

The CV was also found to be significantly affected by the choice of the initial scan potential, $E_i$. If $E_i$ was very anodic (e.g., 1800 mV), three reduction and two oxidation peaks were observed as shown in FIG. 3(*c*). However, if $E_i$ was made more cathodic, the CV became ill-defined and only the first reduction/oxidation peaks were observed with decreased peak heights and separations (see FIG. 3(*d*)). Experiments in which the initial potential was held constant (e.g., at 600 mV) for ten seconds and then cycled resulted in an increase in the cathodic current, suggesting that the three step reduction is probably due to the initial oxidation of the complex at high anodic potentials. It is believed that peak-1 represents the reduction of Cu(II)→Cu(O), perhaps from an initially adsorbed layer.

The cyclic voltammograms for $(\mu_4\text{-O})N_4Cu_3NiCl_6$ in MC/0.1M TBAP with GC (repolished after each scan) at scan rates of 500, 1000, and 1500 mV/s are shown in FIG. 3(*b*). With increasing scan rate, the reduction peaks shifted cathodically, the oxidation peaks (i.e. peaks 2 and 4) shifted anodically, and peak height increased. Peak 4 appeared to be highly sensitive to surface conditions, varying in height and position with each CV experiment. The cyclic voltammograms for $(\mu_4\text{-O})N_4Cu_4Cl_6$ and $(\mu_4\text{-O})N_4Cu_2Ni_2Cl_6$ exhibited similar behavior under the same conditions. Three reduction peaks and two oxidation peaks were observed for $E_i$=1800 mV. The exception was for $(\mu_4\text{-O})N_4Cu_2Ni_2Cl_6$ where peak 4 was always absent.

In contrast, $(\mu_4\text{-O})py_4Cu_4Cl_6$ in 0.1M TBAP/MC yielded somewhat ill-defined peaks at GC. However, when TBAF was used as the electrolyte (with GC) or when platinum was used as the electrode with either electrolyte, four well-defined peaks were observed with peaks 1, 3, and 5 each shifted cathodically by more than 200 mV. On the other hand, peak 2 was nearly the same as when the ligand was N. It appears that the electrolyte plays a role in the electrochemical behavior with py as the ligand.

The following considerations can be drawn from the experiments described above: (1) the heteropolymetallic compounds of the series $(\mu_4\text{-O})L_4Cu_{4-x}Ni_xCl_6$, wherein L is py or N, are electroactive; (2) the response of the system is highly dependent on initial potential; (3) more energy is required for reduction and oxidation as the number of Cu atoms is decreased; (4) differences in peak potentials are observed for different ligands with constant metal ratios and with different electrolytes; (5) surface morphology of the reduced and/or oxidized material is highly dependent upon the deposition potential; and (6) electrochemical reduction of the subject transmetalation complexes resulted in the formation of surface films and micron-sized particles composed of both pure Cu and single phase CuNi alloy.

The embodiments of the present invention recited herein are intended to be merely exemplary and those skilled in the art will be able to make numerous variations and modifications to it without departing from the spirit of the present invention. All such variations and modifications are intended to be within the scope of the present invention as defined by the claims appended hereto.

What is claimed is:

1. A method of producing a metal or metal alloy comprising the steps of:

(a) providing a polymetallic complex of the formula:

$$(\mu_4\text{-O})L_4M'M''M'''M''''X_n$$

wherein L is a ligand selected from the group consisting of organic ligands and inorganic ligands, wherein M', M'', M''', and M'''' are metal atoms, wherein X is a halide, and wherein n is an integer ranging from 4 to 6; and (b) then, applying an appropriate electric potential to said polymetallic complex to cause the electrochemical deposition of at least one of M', M'', M''', and M''''.

2. The method as claimed in claim 1 wherein L is a ligand selected from the group consisting of pyridine and N,N-diethylnicotinamide.

3. The method as claimed in claim 1 wherein X is a halide selected from the group consisting of chloride, bromide, and iodide.

4. The method as claimed in claim 1 wherein said polymetallic complex is of the formula:

$$(\mu_4\text{-O})L_4Cu_{4-y}Ni_yX_n$$

wherein $0 \leqq y \leqq 4$.

5. The method as claimed in claim 4 wherein L is selected from the group consisting of pyridine and N,N-diethylnicotinamide, wherein X is Cl, and wherein n is 6.

6. The method as claimed in claim 5 wherein L is N,N-diethylnicotinamide and y is 1-3.

7. The method as claimed in claim 1 wherein said polymetallic complex is of the formula:

$$(\mu_4\text{-O})L_4Cu_{4-w-y-z}Co_wNi_yZn_zX_n$$

wherein w and y are each integers ranging from 0 to 4, wherein z is an integer ranging from 0 to 2, and wherein $0 \leqq w+y+z \leqq 4$.

8. The method as claimed in claim 7 wherein L is selected from the group consisting of pyridine and N,N-diethylnicotinamide, wherein X is Cl, and wherein n is 6.

9. The method as claimed in claim 1 wherein said appropriate electric potential is a cycled electric potential.

10. The method as claimed in claim 9 wherein said cycled electric potential is cycled between +1800 mV and −950 mV at a scan rate of 500 mV/s.

11. The method as claimed in claim 1 wherein said appropriate electric potential is a constant electric potential.

12. The method as claimed in claim 1 wherein said appropriate electric potential is +1800 mV for 5 seconds and then +100 mV for an additional 5 seconds.

13. The method as claimed in claim 1 wherein step (b) is performed at or near room temperature.

14. A method for synthesizing a metal or metal alloy comprising the steps of:

a) providing a polymetallic complex of the formula:

$$(\mu_4\text{-O})L_4M'M''M'''M''''X_n$$

wherein L is a ligand selected from the group consisting of organic ligands and inorganic ligands, wherein M', M'', M''', and M'''' are metal atoms two or more of which may be the same, wherein X is a halide, and wherein n is an integer ranging from 4 to 6;

b) dissolving said polymetallic complex in an appropriate solvent containing an appropriate conducting electrolyte; and c) then, applying a sufficient electric potential to electrochemically deposit at least one of the metal atoms from said polymetallic complex onto an appropriate working electrode.

15. The method as claimed in claim 14 wherein said solvent is selected from the group consisting of methylene chloride and acetonitrile.

16. The method as claimed in claim 14 wherein said conducting electrolyte is selected from the group consisting of tetraalkyl ammonium perchlorates and tetraalkyl ammonium tetrafluoroborates.

17. The method as claimed in claim 14 wherein said working electrode is selected from the group consisting of platinum and glassy carbon.

18. A method for synthesizing a metal or metal alloy comprising the steps of:

a) providing a polymetallic complex of the formula:

$$(\mu_4\text{-O})L_4M'M''M'''M''''X_n$$

wherein L is a ligand selected from the group consisting of organic ligands and inorganic ligands, wherein M', M'', M''', and M'''' are metal atoms two or more of which may be the same, wherein X is a halide, and wherein n is an integer ranging from 4 to 6; and b) then, electrochemically reducing said polymetallic complex so as to deposit at least one of M', M'', M''', and M'''' onto an appropriate substrate.

19. A method for synthesizing a metal or metal alloy comprising the steps of:

a) providing a polymetallic complex of the formula:

$$(\mu_4\text{-O})L_4M'M''M'''M''''X_n$$

wherein L is a ligand selected from the group consisting of organic ligands and inorganic ligands, wherein M', M'', M''', and M'''' are metal atoms two or more of which may be the same, wherein X is a halide, and wherein n is an integer ranging from 4 to 6;

b) then, oxidizing said polymetallic complex to form an intermediate complex; and c) then, electrochemically reducing said intermediate complex to deposit at least one of M', M'', M''', and M'''' onto an appropriate substrate.

* * * * *